United States Patent [19]

Lindblad et al.

[11] 4,384,391

[45] May 24, 1983

[54] BUCKLE FOR SAFETY BELTS

[75] Inventors: Stig M. Lindblad, Alfa delpi, Alicante, Spain; Lars-Eije Berg, Vargarda, Sweden

[73] Assignee: Stig M. Lindblad, Alicante, Spain

[21] Appl. No.: 242,884

[22] Filed: Mar. 12, 1981

[30] Foreign Application Priority Data

Mar. 12, 1980 [SE] Sweden ..... 8001925

[51] Int. Cl.[3] ..... A44B 11/25

[52] U.S. Cl. ..... 24/230 A; 24/230 AL

[58] Field of Search ..... 24/230 A, 230 AL, 230 AK

[56] References Cited

U.S. PATENT DOCUMENTS 4,004,115 1/1977 Esner ..... 24/230 A 4,206,533 6/1980 Meiller et al. ..... 24/230 A

*Primary Examiner*—Hugh R. Chamblee

[57] ABSTRACT

Buckle for safety belts, which are provided with belt straps and two coupling components. Said coupling components are intended for detachable coupling together of the belt strap. One coupling component comprises a lockable part (1), and the other coupling component comprises a locking part. The locking part is provided with a locking element (9), which is pivoted in the locking part. The locking element can be switched over between a position releasing the lockable part and a position, in which it locks said part. The locking element is further spring loaded, so that it tends to pivot to its releasing position. A catching element (29) forms part of the locking part and can be switched over between a catch position, in which the locking element is impeded from being switched over from its locking position, and a releasing position, in which the locking element is permitted to pivot to its releasing position. The catching element (29) can during its switch over between its catching position and its releasing position displace itself partly for a distance substantially parallel to the direction of movement of the lockable part (1) when the buckle is coupled together or released respectively, and partly for a distance in a direction that intersects said direction of movement for the component, that can be locked.

9 Claims, 6 Drawing Figures

BUCKLE FOR SAFETY BELTS

The present invention relates to a buckle for safety belts with straps and two coupling components, which are intended for detachable coupling together of the belt strap, and of which one coupling component comprises a lockable part and the other component comprises a locking part, which is provided with a locking element, which is pivoted in the locking part and arranged to be reset between a position, in which it releases the lockable part, and a position, in which it locks the same, said locking element being spring loaded, so that it tends to pivot to its releasing position, a catching element forming part of the locking part, being able to be reset between a catch position, in which the locking element is impeded from being switched out of its locking position, and a releasing position, in which the locking element is permitted to pivot into its releasing position.

Buckle-equipped safety belts of the kind mentioned in the preamble of claim 1 are by way of example described in the Swedish application for patent 7704854-4. A locking element forms part of this known mechanism, said locking element being displaceable in the inserting direction of a locking tongue forming part of the device, a pivoted locking element being designed in such a manner that the locking element can be swung round, so that it occupies a releasing position, when the locking element is displaced in said direction. The locking element exhibits an edge, that has to be overcome, there being a risk that the locking element gets caught on this edge, which brings in its train that a partial locking takes place. Partial locking is a very difficult problem to solve when designing buckles for safety belts and it is indeed a very essential problem because of the fact that a partial locking may signify that both coupling parts of the buckle are disengaged from each other, when the safety belt is subjected to a load, by way of example in connection with an accident. It is an object of the present invention to eliminate the risk of partial locking and to provide a buckle, which is simple to manufacture and fulfils very rigid demands with respect to function, durability etc. Said object is obtained by means of a buckle for safety belts which is characterized by the catching element being arranged during its switch-over between its catching position and is releasing position to displace itself partly for a distance substantially parallel to the path of movement of the lockable part, when a coupling together of release respectively of the component of the buckle is taking place and partly for a distance in a direction, that cuts said direction of movement of the lockable part.

Figure 1:
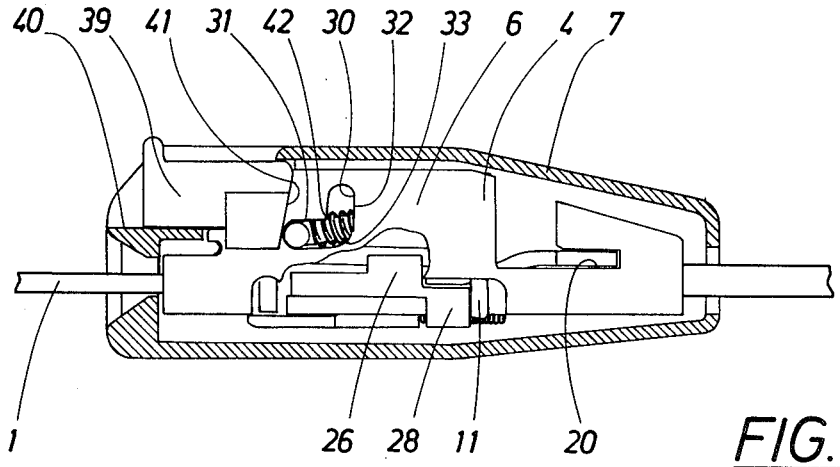
Figure 2:
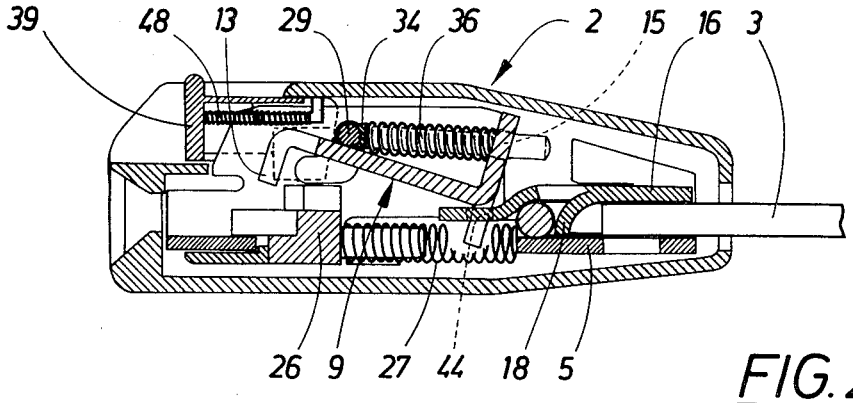
Figure 3:
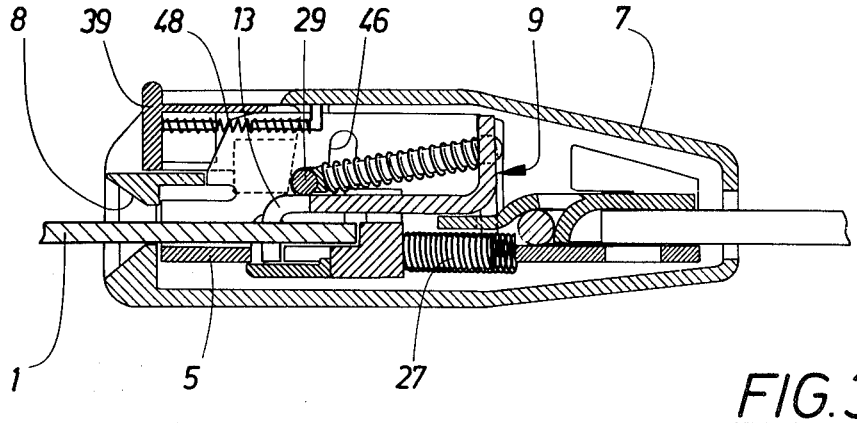
Figure 4:
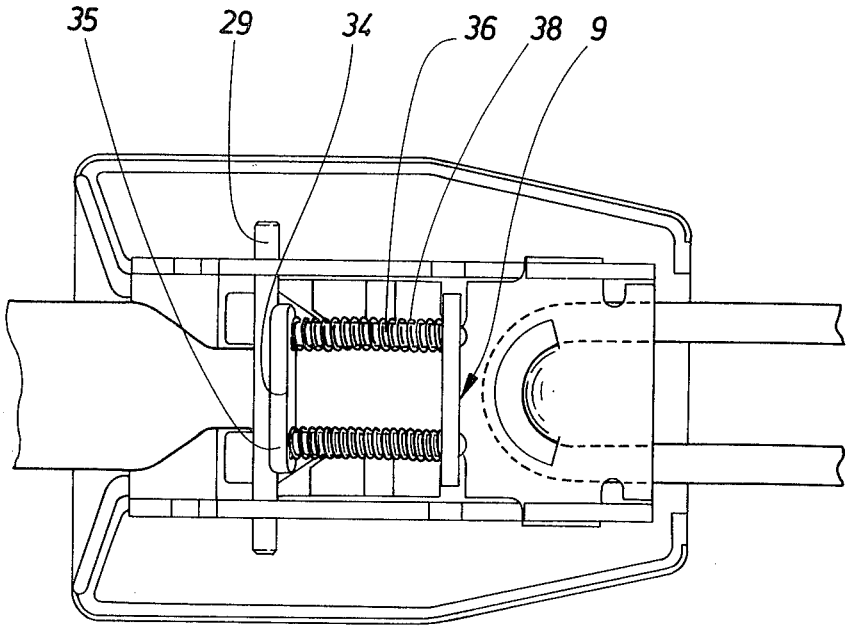
Figure 5:
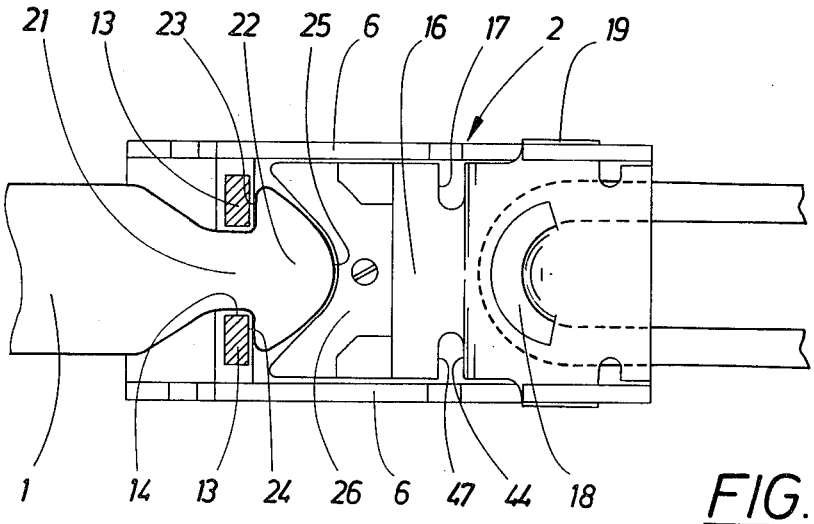
Figure 6:
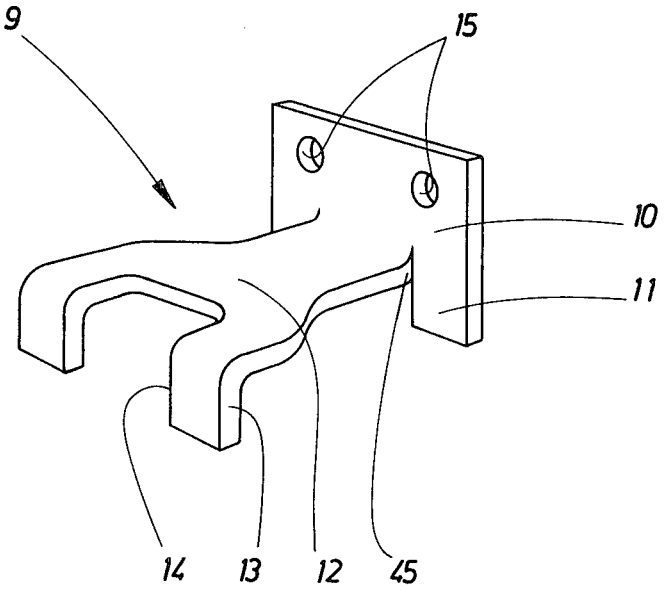

The invention will now be described in the following by means of an example of embodiment of the same, reference being made to the accompanying drawings in which FIG. 1 is a partially broken side elevational view of the buckle according to the invention as seen in its locking position, FIG. 2 shows a central cross-section through the buckle according to the invention as seen in a releasing position, FIG. 3 shows a corresponding cross-section of the buckle in a locking position and FIG. 4 is a top view of the buckle according to the invention with a portion of a casing removed, FIG. 5 is a top view of the buckle according to the invention, the casing and portions of the locking means being removed, and FIG. 6 is a perspective view of a locking element forming part of the buckle.

The buckle according to the invention is composed of two coupling components, viz. a lockable part and a locking part, said components comprising a locking tongue 1 and a locking means 2 respectively. The locking tongue 1 is usually coupled to a strap of the safety belt and by way of example designed with a slit, not shown, through which the belt strap is running and being deflected between the hip portion and chest portion of the safety belt, as in the case in the safetybelts of the three-point type. In the illustrated example the locking means 2 is anchored to a fixed portion of for example a vehicle, by way of example to the floor or to the tunnel of the universal driving shaft of the vehicle, by means of a pulling element 3, which in the illustrated example is designed as a wire-loop. This wire-loop is suitably so flexible that it accommodates itself in the desired direction in connection with the coupling together of the buckle parts.

The locking means 2 comprises a supporting part 4, for example made of metal, of U-shaped cross-section and thus exhibits a bottom portion 5 and two identically formed end pieces 6. The locking means 2 is enclosed in a casing 7, suitably of an easily moulded material as for example plastics, which casing in the illustrated example is a two part structure and exhibits an opening 8 for the insertion of the locking tongue 1. The locking tongue can be inserted into the locking means through this opening 8 along a path of movement at the bottom portion of the supporting part 4 and can be locked in a manner, that will be described below. To this effect a locking element 9 forms part of the locking means, the design of which locking element according to the illustrated example is best evident from FIG. 6. The locking element exhibits a cross piece 10 substantially exhibiting the form of an inverse U, which consequently exhibits downwards pointing branches 11. A gable shaped portion 2 exhibiting two legs 13 substantially parallel to the two branches 11 projects from the central portion of the cross piece 10. Thus, a rectangular notch 14 is formed between these legs. Two bores 15 are made in the upper portion of the cross piece 10.

The locking element 9 is pivoted relative to the supporting part 4 between a locking and a releasing position, i.e. locking the locking tongue 1 to the locking means and releasing the locking tongue from the same respectively. However, the locking element 9 is not pivoted on the holder portion but on a plate 16 acting as an intermediary of the load and is by way of example stamped out of a metal plate and shaped in such a manner that it acquires the design illustrated in FIGS. 2 and 5. The two branches of the locking element 9 in fact project downwards each one in its recess of two recesses 17 made in the plate 16, whereas the pulling element 3 is laid round a downwards pressed bent portion 18 of the plate 16. This plate further exhibits two sideways pointing wings 19, which are laid in corresponding recesses 20, (see FIG. 1), of the end pieces 6 of the supporting part 4. By this arrangement the pulling element 3 is held in place between the load absorbing plate 16 and the bottom portion 5 of the supporting part 4. The plate 16 is mounted in a very simple manner in the manufacturing process of the buckle, it simply being inserted into the recesses 20 of the supporting part at the same time as the pulling element 3 is held in place, whereby any special working moment or any special fastening means such as a screw, a rivet etc. for holding the pulling element is not required.

The manner in which the locking element 9 cooperates with the locking tongue 1 is evident from FIGS. 3 and 5. The locking element 9 extends downwards in locking position into the path of movement of the locking tongue 1 along the bottom portion 5 of the supporting part 4 in such a manner that both legs 13 of the locking element extend downwards on both sides of the neck 21 of the locking tongue, which neck penetrates into the notch 14 of the locking element. The locking tongue is in an in itself known manner provided with a head 22 with backwards facing stop edges 23, which cooperate with stop faces 24 of the legs 13 of the locking element 9. The locking tongue exhibits a rounded end portion 25, which is arranged to cooperate with an ejector 26, which is movable in the direction of movement of the locking tongue 1 in the locking means and by means of a pressure spring 27 subjected to a load operating in a direction opposite to the direction of insertion of the locking tongue, with arrangement is best illustrated in FIGS. 2 and 3. The ejector 26 is for example made of an easily moulded material, such as plastics, and is consequently movable between an outer position, which it occupies, when the locking tongue is removed from the locking means (see FIG. 2), and an inner position, which it has occupied under actuation of the locking tongue against the bias of the pressure spring 27 (see FIG. 3). The ejector 26 exhibits a portion 28, which is evident from FIG. 1, and is arranged to apply a pressure force to the branches 11 of the locking element 9 in the direction of insertion of the locking tongue in order to switch the locking element from its releasing position illustrated in FIG. 2 to its locking position, illustrated in FIG. 3, which will be described more in detail below.

A catching element forms moreover part of the locking means and is in the illustrated example of embodiment designed as a bar, for which reason it will be mentioned as the catching bar 29 in the following. The catching bar extends through two guiding slits 30, one slit in each one of the end pieces 6, and is movable along a path, which is determined by the shape of the slits 30. As is best evident from FIG. 1, each slit is designed with a portion 31, which extends substantially parallel to the path of movement of the locking tongue 1, and with a portion 32, which extends in direction away from the path of movement of the locking tongue extending along the bottom portion 5 of the supporting part 4. Thus, the extension of the portion 32 cuts the path of movement of the locking tongue or the prolongation of said path. Thus, the slits 30 are of angular shape and in this example of embodiment exhibit a slightly obtuse angle along its outer edge between the two portions 31, 32 exhibiting a rounded-off outer corner 33. The inner corner 42 of the slits 30 can be relatively sharp-angled.

As is best evident from FIGS. 2 and 4 a substantially U-shaped piece 34 operates against the catching bar 29, a cross piece 35 of said U-shaped piece 34 being arranged to abut against the catching bar and therefore on its outside exhibits a concave surface like the surface of a cylinder barrel. Two branches 36 extend from the cross piece penetrating the bores 15 of the locking element 9. The two branches 36 suitably exhibit a substantially cylindric shape, and, as is evident from FIG. 2, are suitably dimensioned relative to the diameter of the bores 15, so that a suitably levelled play is obtained in order to permit a well balanced cooperation between the locking element and the catching bar. Instead of said play of two branches 36 can as an alternative be made so flexible that at least in one end position of the catching bar 29 they can acquire a bent form. A pressure spring 38 extends round each one of the two branches 36 and is biased between the cross piece 34 and the locking element 9.

The catching bar 29 is operated by means of a trigger 39, which is accessible from the outside through an opening 40 in the casing 7. The trigger is displaceable in the longitudinal direction of the buckle, i.e. in the direction of insertion of the locking tongue, and exhibits an inner portion 41, which is arranged to abut against the catching bar 29, when the trigger is pushed inwards. This portion 41 occupies an oblique position in a manner, which is best evident from FIG. 1, whereby a pressure force will be directed against the outer corner 33 of the slits 30, when a pressure in inwards direction is exercised. By this arrangement the locking element is impeded from exercising a pressure against the inner corner 42 of the slits. This brings in its train that a hooking up of the locking element on the inner corner 42 of the slits is avoided, whereby still another risk of partial locking is eliminated. In the illustrated example of embodiment the trigger 39 is spring loaded by means of a pressure spring 48, which, thus, by being supported by a portion of the casing 7 provides a retro-active force for the trigger in order to move the same into an outer position according to FIG. 1, after it has been pressed in.

The buckle according to the invention functions in the following manner. When the two coupling components of the buckle have been disengaged from each other, i.e. when the locking tongue 1 is removed from the locking means 2, the locking means is in a releasing position, as is shown in FIG. 2. Thus, this position is occupied, when the belt is not in its position of use but is disengaged, the strap of the belt being wound up by means of a winding-up device, not shown, which in an in itself known manner is arranged to be locked, when the vehicle is subjected to abnormal changes of speed. The belt can also be of the static type, which is not provided with any winding-up mechanism. In the releasing position of the locking means 2 the catching bar 29 is in a releasing position, i.e. at the outer end of the portion 32 of the guiding slits 30 extending across the path of movement of the locking tongue 1. By this arrangement and because of the fact that the pressure spring 36 exercises a pressure force on the locking element 9, the latter one is kept in its releasing position, i.e. swung upwards in such a manner that the legs 13 of the locking element are moved aside from the path of movement of the locking tongue 1. In the illustrated example of embodiment the trigger 39 is in its inner position, as long as it is pressed in, whereas the ejector 26 is in its outer position by actuation of the pressure spring 27 belonging to the assembly. As soon as the pressure exercised in inwards direction ceases to exist, the trigger 39 springs back into its outer position.

When the locking tongue 1 is inserted into the locking means 2 through the opening of introduction 8 entering its path of movement, which extends from said opening and along the bottom portion 5 of the supporting part 4, the locking tongue with its free end 25 will first arrive in contact with the ejector 26, which thereby is moved inwards against bias of its pressure spring 27. In a well balanced position of the locking tongue 1, the portions 28 of the ejector 26 will arrive in contact with the two branches 11 of the locking element 9, which project downwards in the path of movement of the ejector 26. When the ejector 26 with its portions 28 during the continued insertion movement of the locking tongue 1 is pressed against the branches 11, said branches are pressed against the edge portions 44 of the recesses 17 of the plate 16, see also FIG. 5. This results in the locking element 9 with its gable shaped piece 12 being brought to pivot in downwards direction in such a manner that the legs 13 are inserted into the path of movement of the locking tongue. The components forming part of the assembly are to this effect adapted in such a manner that when the locking element is pivoted downwards the locking tongue will occupy a position, in which its stop edges 23 extend as seen in the direction of insertion of the locking tongue, inside the place, where the legs 13 of the locking element can be moved downwards on both sides of the neck portion 21 of the locking tongue 1.

The locking element 9 substantially rests with its rounded-off portion 45 and immediately adjoining surfaces against a portion of the plate substantially located between the two recesses 17, for which reason these two portions abutting against each other together with the surfaces of the branches 11 and the stop edges 44 abutting against each other form the bearing of the locking element 9, round which bearing the locking element can pivot. By said pivoting movement to locking position also the U-shaped piece 34, which abuts against the ratchet bar and pressure springs is subjected to forces. The locking element 9 pivots downward first, possibly unto its locking position, before the U-shaped piece and the catching bar 29 displace themselves. During the pivoting movement of the locking element 9 the pressure springs 38 are in fact compressed resulting in a pressure being exercised against the catching bar 29 via the cross piece 35, and this brings in its train that the catching bar 29 displaces itself in its slits 30. A favourable case is just when the components forming part of the assembly are dimensioned in such a manner that the locking element 9 first pivots down into locking position, before the catching bar 29 is displaced, which still further reduces the risk of partial locking by the catching bar getting hooked up. As a matter of fact at least the inner edge 46 of the transversally extending portion 32 of the slits 30 are in the illustrated example of embodiment somewhat obliquely arranged, by way of example by 15° relative to the vertical line in the drawing, as is best evident from FIGS. 1 and 3, which involves that the catching bar displaces itself in the slits 30, when the pressure springs are sufficiently compressed in order to make possible that a downwards directed force shall acquire such magnitude that friction forces, which operate on the catching bar, shall be overcome. This condition can thus be balanced by chosing a suitably oblique position of the inner edge and a suitable spring force. The locking means has then occupied a locking position, the catching bar 29 in the manner described above having been moved into catch position according to FIGS. 1 and 3. from which it is evident that the catching bar then is at the end of the portion 31 of the slits 30 substantially extending in the direction of insertion of the locking tongue. By the compression of the pressure springs 38 and the design of the slit the catching bar 29 is firmly held in this position and impedes the locking element 9 from being swung upwards into a releasing position. The trigger 39 is still in its outer end position.

In order to disengage the safety belt, i.e. a release of the locking tongue 1, the trigger 39 is pressed in, the catching bar 29 because of its abutment against the oblique portion 41 of the trigger 39 following the latter one in its movement. On account of the oblique position of the portion 41 the catching bar 29 is all the time kept along the outer edge and outer corner 33 of the guiding slits, as had already been mentioned above, and by this arrangement the risk of the catching bar getting hooked up against the inner corner 42 is completely eliminated. During the displacement of the catching bar 29 along the portion 31 of the guiding slits 30 the pressure springs 38 are compressed, whereby a torque appears on the locking element producing the effect that this element can be pivoted upwards round its bearing into the releasing position illustrated in FIG. 2. Also here the components forming part of the assembly are dimensioned in such a manner that the catching bar 29 has time to displace itself at least along the portion 31 of the slits 30, before the locking element 9 pivots upwards, whereby any risk of jamming of the catching bar is completely eliminated. This is by way of example brought about by suitable dimensioning of the force exercised by the pressure springs 38 on the locking element 9, so that only when the catching bar 29 is in the area of the outer corner 33 of the guiding slits such a pressure on the locking element will arise that it can perform its pivoting movement, the catching bar 29 then being moved upwards to the end of the transversally extending portion 32 of the guiding slits 30 by actuation of the locking element 9. The locking element 9 has then occupied its releasing position according to FIG. 2 and the locking tongue 1 is ejected out along its path of movement through the opening of insertion 8 by actuation of the ejector 26, which obtains its ejection force from the compressed pressure spring 27.

As is evident from the function described above the buckle according to the invention exhibits a very reliable function and is moreover of a very simple design. The buckle can be easily released even in connection with very great pulling forces, and the belt can therefore be very quickly released in an emergency situation even by an injured user of the belt. As is evident from FIG. 3 only very few components are subjected to the pulling force operating on the safety belt. As a matter of fact the pulling forces are transmitted from the locking element 9 directly to the plate 16 via the branches 11 and the edge surfaces 47 of the recesses 17. The pulling forces are further transmitted from the plate 16 and more in particular from its bent down portion 18 to the pulling element 3. This means that the supporting part 4 is not subjected to the very high pulling forces occurring in connection with accidents, and the casing 7 is likewise entirely free from these loads.

As hinted above, the buckle is moreover very easy to manufacture, and this goes for the manufacture of individual details which as regards the load absorbing components substantially comprise stamped out and bent components of sheet plate, as well as for the mounting operation, when the buckle is assembled, as most of the components do not require any special fastening elements or similar. The plate 16 can by way of example simply be laid in its place, as hinted above, and the locking element 9 likewise be laid in place in a very simple manner.

The invention is not limited to the example of embodiment described above and illustrated in the drawings, but can be varied within the scope of the following claims. The trigger 39 can by way of example be designed in such a manner that it is not spring loaded by means of a separate spring, so that after being pressed in, it does not spring back to its outer position, but instead stops in its inner position according to FIG. 2. The locking element 9 can moreover exhibit another appearance than the one illustrated. However, it is an essential feature of the invention that the surface cooperating with the catching bar 29 needs not exhibit any shoulder, against which the catching bar can get hooked up, as this catching bar by its path of movement in two directions is moved aside, for one thing substantially along the path of movement of the locking tongue and for another thing in direction away from said path. An additional essential characteristic is the bearing arrangement for the locking element 9 not exhibiting any physical bearing shafts. The power transmission from the locking element 9 to the catching bar 29 can further be arranged with other components than the U-shaped piece, the pressure springs 38 and the bores 15. The plate 16 can likewise be designed in a different manner, for example in such a case, where the pulling element 3 is of another type than a wire-sling. The locking tongue can further exhibit another appearance, the design appearance of the locking element 9 can then also be adapted to the locking tongue. The locking tongue can by way of example be designed with a rectangular hole, into which the locking element is arranged to project in downwards direction, the two legs then being substituted by a centrally located downwards directed leg. The guiding slits 30 can be designed with their edges exhibiting other tilting angles.

We claim:

1. Buckle for safety belts provided with belt straps and two coupling components, which are intended to detachable coupling together of the belt strap, and of which one coupling component comprises a lockable part, and the other component comprises a locking part, which is provided with a locking element, which is pivoted in the locking part and arranged to be reset between a position, in which it releases the lockable part, and a position, in which it locks the same, said locking element being spring loaded, so that it tends to pivot to its releasing position, a catching element forming part of the locking part being able to be reset between a catch position, in which the locking element is impeded from being switched out of its locking position, and a releasing position, in which the locking element is permitted to pivot into its releasing position, wherein the locking part is provided with guide means provided to guide the catching element during its switch-over between its catching position and its releasing position to displace itself partly for a distance substantially parallel to the path of movement of the lockable part, when a coupling together or release respectively of the components of the buckle is taking place, and partly for a distance in a direction, that intersects said direction of movement of the lockable part.

2. Buckle according to claim 1, wherein said guide means for the catching element is at least one slit, which is designed with each other angularly set portions, and the edges of which form guiding edges for the catching element.

3. Buckle according to claim 2, wherein one portion of the slit extends substantially parallel to the direction of movement of the lockable part and the other portion extends in a direction away from the lockable part, when said part occupies a locking position.

4. Buckle according to claim 3, wherein the two each other angularly set portions are substantially somewhat tilted relative to each other, the portion of the slit, which cuts the direction of movement of the lockable part, exhibiting an inner edge, which exhibits an obtuse angle relative to the other portion of the slit.

5. Buckle according to any one of the preceding claims, wherein the switchover movement of the catching element from its releasing position to its catching position is brought about by means of elements which are coupled partly to the catching element and partly to the locking element in such a manner that the catching element is loaded with a pressure force, which increases during the switch-over of the locking element from a releasing to a locking position and which tends to move the catching element into its catch position.

6. Buckle according to any one of the claims 1 to 4, wherein the switchover of the catching element from a locking to a releasing position is brought about by means of a movable trigger unit, which exhibits an oblique portion, which is arranged at least during the switch-over movement to abut against the catching element and occupies such an oblique position that the catching element is pressed against the outer corner of the slit and the guiding edges belonging thereto during its displacement from a releasing position to a locking position.

7. Buckle according to any one of the claims 1 to 4, wherein the locking element is pivoted in a load absorbing part and exhibits at least one first portion substantially extending across the direction of movement of the lockable part, which portion penetrates into a corresponding recess of the load absorbing part, and a second portion, by means of which the locking element rests on a surface of the load absorbing part, which via a pulling element is coupled to a rigid portion of a vehicle or similar.

8. Buckle according to claim 7, wherein said portion, which substantially extends across the direction of movement of the lockable part projects downwards below said recess of the load absorbing part and is arranged by insertion of the lockable part into its locking position to be subjected to a pressure force operating in the direction of insertion of the lockable part, and thereby be pivoted into a locking position.

9. Buckle according to claim 8, wherein the lockable part comprises a locking tongue with at least one edge crosswise positioned relative to the principal direction of load, said edge facing backwards relative to the direction of insertion of the locking tongue, wherein the locking part exhibits a supporting part, which exhibits a bottom portion and two gable pieces, which each one exhibits said slit, wherein the catching element comprises a bar extending between the gable pieces and penetrating into the slits, wherein the locking element exhibits a substantially plane third portion at least in locking position abutting against the catching element and extends substantially parallel to one portion of the slits, at least one leg extending in crosswise direction from said leg for engagement with said edge of the locking tongue and a transversal piece, which via spring mechanism cooperates with the catching element.

* * * * *